US007044795B2

(12) United States Patent
Diep

(10) Patent No.: US 7,044,795 B2
(45) Date of Patent: May 16, 2006

(54) MINIATURE, SHIELDED ELECTRICAL CONNECTOR WITH STRAIN RELIEF

(75) Inventor: Chuong H. Diep, Enfield, CT (US)

(73) Assignee: Hamilton Sundstrand, Windsor Locks, CT (US)

( * ) Notice: Subject to any disclaimer, the term of this patent is extended or adjusted under 35 U.S.C. 154(b) by 39 days.

(21) Appl. No.: 10/404,999

(22) Filed: Apr. 1, 2003

(65) Prior Publication Data

US 2004/0198091 A1 Oct. 7, 2004

(51) Int. Cl.
*H01R 9/03* (2006.01)

(52) U.S. Cl. ..... 439/610; 439/471

(58) Field of Classification Search ..... 439/464, 439/466, 471, 468, 607, 610, 95, 469
See application file for complete search history.

(56) References Cited

U.S. PATENT DOCUMENTS

| | | | | |
|---|---|---|---|---|
| 3,638,169 | A * | 1/1972 | Caveney et al. | 439/471 |
| 3,920,306 | A * | 11/1975 | Barnett et al. | 439/459 |
| 4,306,760 | A * | 12/1981 | Testa | 439/468 |
| 5,282,760 | A * | 2/1994 | Aimasso | 439/752 |
| 5,295,859 | A * | 3/1994 | Kawai et al. | 439/455 |
| 5,558,539 | A * | 9/1996 | Lignelet | 439/610 |
| 5,575,681 | A | 11/1996 | Muzslay et al. | |
| 5,725,395 | A * | 3/1998 | Lee | 439/610 |
| 5,755,597 | A * | 5/1998 | Panis et al. | 439/610 |
| 5,820,412 | A * | 10/1998 | Koegel et al. | 439/610 |
| 5,895,291 | A * | 4/1999 | Furio et al. | 439/610 |
| 5,911,595 | A * | 6/1999 | Orr et al. | 439/471 |
| 6,276,967 | B1 * | 8/2001 | Hall | 439/610 |
| 6,339,193 | B1 * | 1/2002 | Goett et al. | 174/78 |
| 6,354,879 | B1 * | 3/2002 | Plehaty | 439/610 |
| 2002/0086583 | A1 | 7/2002 | Casey | |
| 2003/0003805 | A1 * | 1/2003 | Yamamoto | 439/610 |

FOREIGN PATENT DOCUMENTS

| | | |
|---|---|---|
| DE | 20110344 U1 | 9/2001 |
| DE | 10065136 A1 | 7/2002 |
| WO | WO/02/43187 A1 | 5/2002 |

OTHER PUBLICATIONS

Traditional Backshell With Strain Relief and Shield Termination Available in Current Industry.
PCT/US2004/009823, Mar. 2004, WOX.

* cited by examiner

*Primary Examiner*—Hien Vu
(74) *Attorney, Agent, or Firm*—Carlson, Gaskey & Olds

(57) ABSTRACT

An electrical connector assembly includes a wire bundle having at least one wire with a metal shield surrounding at least a portion of the wire. The shield has an end portion and provides electromagnetic interference protection to the wire. A backshell includes a body and a cover secured to the body together defining an internal cavity with the wire at least partially arranged within the cavity. The backshell provides EMI protection for the portion of the wire bundle not covered by the shield. The backshell includes a hole in a wall of either the body or the cover with the end portion of the shield extending through the hole. The clamp is secured about the body and the cover with the end portion of the shield arranged between the clamp and the backshell grounding the shield to the backshell. The clamp forces the backshell into engagement with the wire bundle to provide strain relief for the wire bundle.

11 Claims, 4 Drawing Sheets

MINIATURE, SHIELDED ELECTRICAL CONNECTOR WITH STRAIN RELIEF

The invention described herein was made in the performance of work under NASA Contract No. NAS9-97150 and is subject to the provisions of Section 305 of the National Aeronautics and Space Act of 1958 (42 U.S.C. 2457).

BACKGROUND OF THE INVENTION

This invention relates to an electrical connector assembly with shielding, and more particularly, the invention relates to strain relief and electromagnetic interference shielding of a wire bundle and electrical connector for use with a space suit.

Space suits used in outerspace typically include a primary life support system having numerous sensors monitoring various characteristics of the occupant of the space suit. Information is transmitted from the sensors to a computer by wires. The wires are connected to the sensors by an electrical connector, which must be as small and light as possible to be accommodated on the space suit. To ensure reliable data transmission over the wires, the wire bundle typically includes a shield for providing electromagnetic interference (EMI) protection. Furthermore, to ensure that data transmission is not lost as a result of a loose wire, strain relief of the wire bundle must be provided where the bundle enters the wire connector or backshell.

Prior art electrical connector assemblies are rather large and includes numerous components. The shield from the wire bundle is clamped to a one-piece backshell to ground the shield to the backshell. A sleeve is threaded over an end of the backshell to surround the shield and the terminal end of the insulation surrounding the shield. An end portion of the insulation is taped and a strain relief nut is threaded onto the sleeve in the area of the tape to provide strain relief to the wire bundle. Using the sleeve and strain relief nut results in a rather large electrical connector assembly. Therefore, what is needed is a smaller electrical connector assembly while still providing EMI protection and strain relief.

SUMMARY OF THE INVENTION AND ADVANTAGES

The present invention provides an electrical connector assembly including a wire bundle having at least one wire with a metal shield surrounding at least a portion of the wire. The shield has an end portion and provides electromagnetic interference protection to the wire. A backshell includes a body and a cover secured to the body together defining an internal cavity with the wire at least partially arranged within the cavity. The backshell provides EMI protection for the portion of the wire bundle not covered by the shield. The backshell includes a hole in a wall of either the body or the cover with the end portion of the shield extending through the hole. The clamp is secured about the body and the cover with the end portion of the shield arranged between the clamp and the backshell grounding the shield to the backshell. The clamp forces the backshell into engagement with the wire bundle to provide strain relief for the wire bundle.

Accordingly, the above invention provides a smaller electrical connector assembly providing EMI protection and strain relief.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
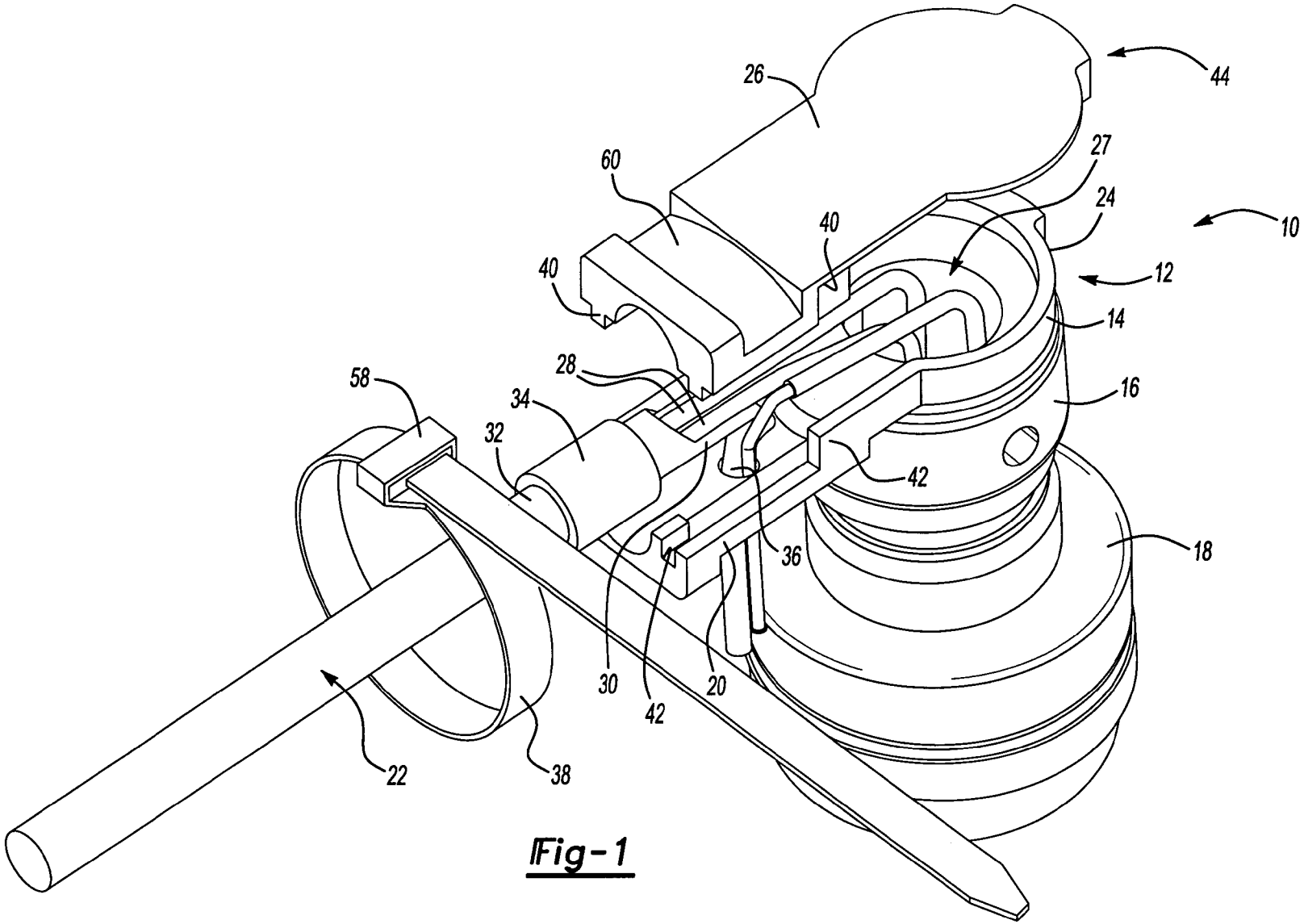
FIG. 1 is an exploded perspective view of the present invention electrical connector assembly.
Figure 2:
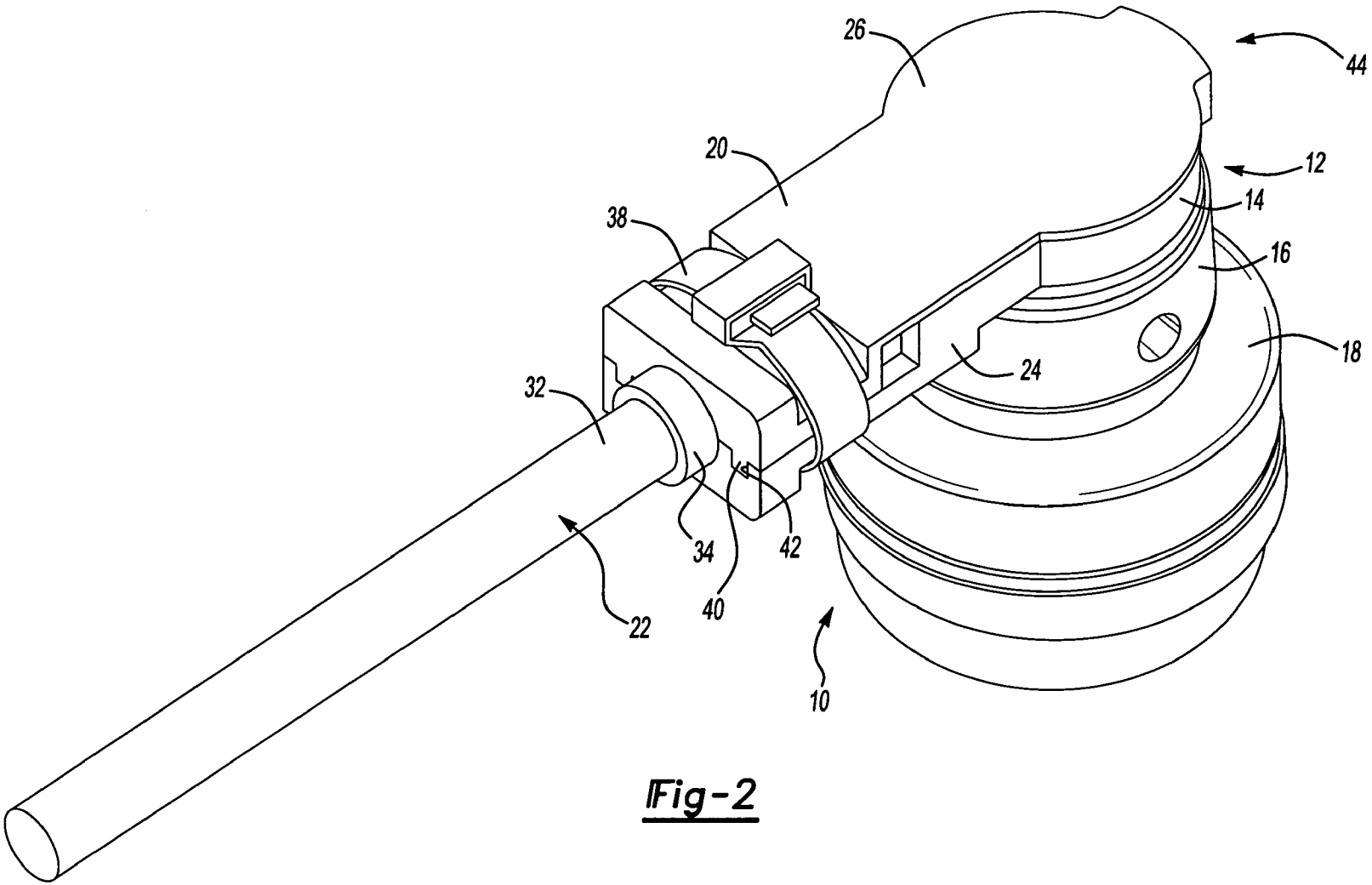
FIG. 2 is a perspective view of the electrical connector assembly shown in FIG. 1 fully assembled.
Figure 3:
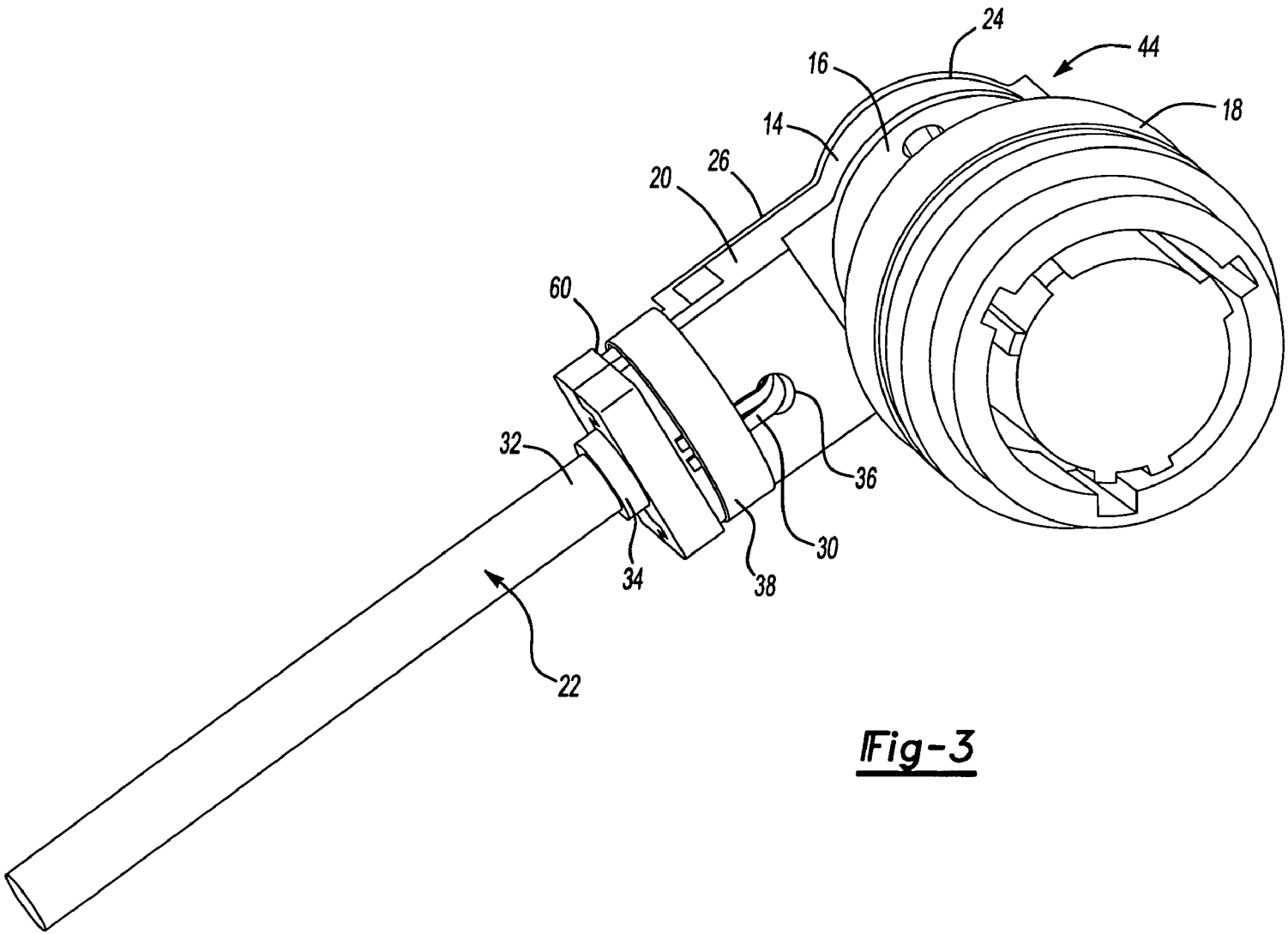
FIG. 3 is a perspective view of the assembly shown in FIG. 2 depicting the underside of the assembly.

An electrical connector assembly 10 is shown in FIGS. 1–3. The assembly 10 includes a backshell 12, which is preferably constructed from a nickel plated aluminum. The backshell 12 includes a base portion 14 having a coupling nut 16 that is threadingly secured to a connector 18. The connector 18 is attached to a corresponding connector on the space suit, which is electrically connected to a sensor monitoring a characteristic of the occupant within the space suit. However, it is to be understood that the present invention electrical connector assembly 10 may be used in any suitable application.

The backshell 12 includes an elongated portion 20 extending transversely from the base portion 14 so that the assembly 10 with its wire bundle 22 may fit closely against the space suit. The wire bundle 22 enters an opening in the elongated portion 20. The backshell 12 includes a body 24 and cover 26, which together define an internal cavity 27 receiving the wires 28 of the wire bundle 22. The two piece backshell 12 of the present invention facilitates the insertion and assembly of the wire bundle 22 and its wires 28.

The wire bundle 22 includes a braided metal shield 30 surrounding the wires 28 to provide electromagnetic interference (EMI) protection to ensure reliable data transmission over the wires 28. The shield 30 is typically surrounded by plastic or rubber insulation 32 to provide protection to the shield 30 and wires 28. Tape 34 is typically wrapped around an end portion of the insulation 32 to increase the diameter of the wire bundle at that location enhancing the interference fit between the wire bundle 22 and the backshell 12 for strain relief of the wire bundle 22. Providing strain relief to the wire bundle 22 ensures that when the bundle 22 is pulled that the wires 28 will not be disconnected from the connector 18. The prior art strain relief nut provided strain relief for the prior art electrical connector assembly.

One of either the body 24 or cover 26 includes a hole 36 through which an end portion 54 of the shield 30 is passed. The backshell 12 includes a groove 60 to capture and locate the clamp 38 in a desired position relative to the hole 36 and tape 34. A clamp 38 is secured about the body 24 and cover 26 to enclose the internal cavity 27, as shown in FIG. 2. The end portion 54 of the shield 30 is arranged between the backshell 12 and clamp 38 to ground the shield 30 to the backshell, as best shown in FIG. 3.

Referring to FIGS. 1 and 2, the cover 26 includes a first lip 40 on the interior face of the cover 26 about its perimeter. The body 24 includes a second lip 42 of a complementary shape to the first lip 40. The first 40 and second 42 lips are adjacent to and in engagement creates a tortuous path that further aids in shielding electromagnetic waves from the wires 28.

Figure 4:
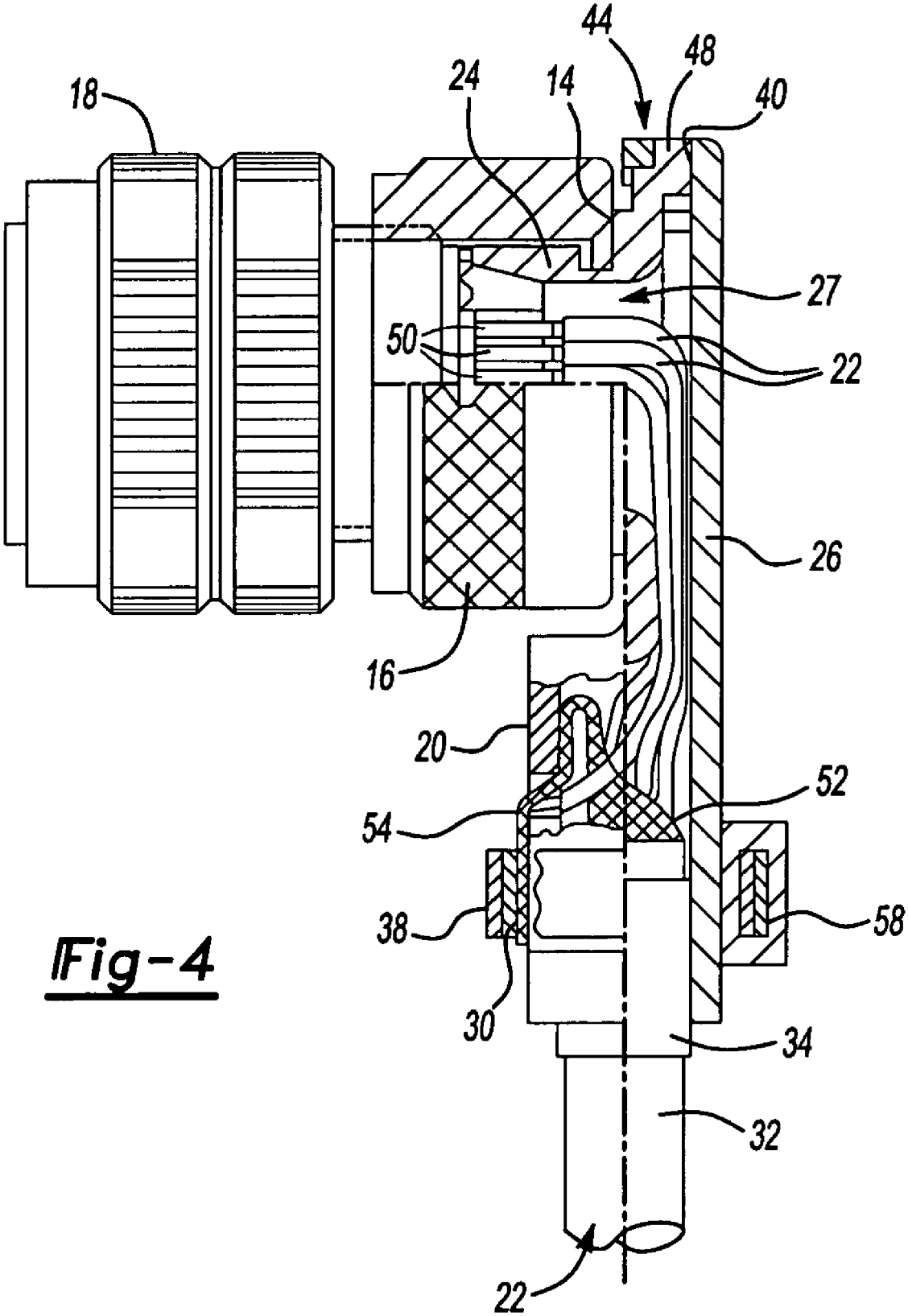
FIG. 4 is a cross-sectional view of the present invention assembly shown in FIG. 2.

Referring to FIG. 4, the assembly 10 includes interlocking features 44 arranged opposite the clamp 38 to further secure the body 24 and cover 26 to one another. The cover 26 includes an aperture 46, and the body 24 includes a tab 48 that is received in the aperture 46 when the cover 26 and body 24 are secured together. The ends of the wires 28 have pins 50 current thereto, which are received by the connector 18.

The present invention electrical connector assembly 10 is assembled by stripping the insulation 32 from the wire bundle 22 a desired amount. The wires 28 are drawn out of the metal shield 30. The insulation of the individual wires 28 is stripped and pins 50 are crimped thereto. The pins 50 are inserted into the connector 18 and the coupling nut 16 is threaded onto the connector. The braided metal shield 30 is pulled through the hole 36 in the body 24 of the elongated portion 20. Tape 34 is wrapped about the insulation 32 near the end of the elongated portion 20 of the backshell 12 to provide sufficient strain relief to the wire bundle 22 when the backshell 12 is assembled. The tab 48 of the cover 26 is inserted into the aperture 46 of the body 24, and the cover 26 is installed onto the body 24 so that the lips 40 and 42 are adjacent to on another. The band clamp 38 is tightened about the groove 60 in the elongated portion 20 of the end portion 54 of the shield 30 arranged between the clamp 38 and the backshell 12. The shield 30 is ground to the backshell 12, and the backshell 12 is forced into engagement with the wire bundle 22 in the area of the tape 34 to create an interference fit and provide strain relief for the wire bundle 22. The end portion 54 of the shield 30 is trimmed back and the cable is checked for proper strain relief.

In this manner, the sleeve and strain relief nut of the prior art are eliminated. As a result, the end of the backshell need not have a large diameter to accommodate the sleeve and nut. For electrical connector assemblies 10 in which shielding is not required, the hole 36 in the backshell 12 may be eliminated.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. An electrical connector assembly comprising:

a wire bundle including at least one wire with a metal shield surrounding at least a portion of said wire providing electromagnetic interference protection to said wire, said shield having an end portion;

a backshell including an elongated body and an elongated cover secured to said body together defining an internal cavity with said wire at least partially disposed therein, said backshell including a hole in a wall of one of said body and said cover with said end portion of said shield extending through said hole, wherein said backshell includes a base portion and an elongated portion extending transversely from said base portion with said body and said cover together forming said base and elongated portions; and a clamp secured about said backshell with said end portion disposed between said clamp and said backshell grounding said shield thereto.

2. The assembly according to claim 1, wherein said hole is arranged in said elongated portion in said body.

3. The assembly according to claim 1, wherein said body and cover respectively include first and second interlocking features spaced from said clamp and securing said cover to said body.

4. The assembly according to claim 3, wherein said interlocking features include an aperture in one of said body and said cover and a tab in the other of said body and said cover with said tab received in said aperture.

5. The assembly according to claim 1, wherein said clamp is disposed about a portion of said elongated portion forcing said backshell into engagement with said wire bundle to provide strain relief for said wire bundle.

6. The assembly according to claim 1, wherein said wire bundle includes insulation surrounding said shield with said end portion of said shield extending from a terminal end of said insulation with said end portion extending alongside said insulation and radially spaced from said terminal end.

7. The assembly according to claim 6, wherein said wire bundle includes tape surrounding said insulation axially spaced from said terminal end with said clamp generally aligned with said tape, said clamp forcing the backshell into engagement with said tape to provide strain relief for said wire bundle.

8. An electrical connector assembly comprising:

a wire bundle including at least one wire with a metal shield surrounding at least a portion of said wire providing electromagnetic interference protection to said wire, said shield having an end portion;

a backshell including an elongated body and an elongated cover secured to said body together defining an internal cavity with said wire at least partially disposed therein, said backshell including a hole in a wall of one of said body and said cover with said end portion of said shield extending through said hole, wherein said body and said cover respectively include first and second lips extending in opposing directions, said Lips adjacent to one another with said cover secured to said body; and a clamp secured about said backshell with said end portion disposed between said clamp and said backshell grounding said shield thereto.

9. An electrical connector assembly comprising:

a wire bundle including at least one wire with a metal shield surround at least a portion of said wire providing electromagnetic interference to said wire, said shield having an end portion;

a backshell including an elongated body and an elongated cover secured to said body together defining an internal cavity with said wire at least partially disposed therein said backshell having a hole in a wall of one of said body and said cover with said end portion of said extending through said hole; and a clamp secured about said body and said cover with said end portion disposed between said clamp and said backshell grounding said shield thereto, said clamp forcing said backshell into engagement with said wire bundle to provide strain relief for said wire bundle.

10. The assembly according to claim 9, wherein said backshell includes a base portion an elongated portion extending transversely from said base portion with said wire bundle received by said elongated portion and said clamp surrounding said elongated portion.

11. The assembly of claim 8, wherein the lips overlap one another.

* * * * *

UNITED STATES PATENT AND TRADEMARK OFFICE

CERTIFICATE OF CORRECTION

PATENT NO. : 7,044,795 B2
APPLICATION NO. : 10/404999
DATED : May 16, 2006
INVENTOR(S) : Diep It is certified that error appears in the above-identified patent and that said Letters Patent is hereby corrected as shown below:

IN THE CLAIMS:

In Claim 9, Column 4, Line 51 of the issued patent, please insert --shield-- after the 3rd occurrence of "said".

Signed and Sealed this

Twelfth Day of September, 2006

JON W. DUDAS
*Director of the United States Patent and Trademark Office*